US005507344A

United States Patent [19]

Young et al.

[11] Patent Number: 5,507,344

[45] Date of Patent: Apr. 16, 1996

[54] METHODS OF COMBATING PRODUCTION PROBLEMS IN WELLS CONTAINING DEFECTIVE GRAVEL PACKS

[75] Inventors: Stephen C. Young, Gretna; Ronald R. Faul, Mandeville; Kent A. Gray, Houma, all of La.

[73] Assignee: Halliburton Company, Duncan, Okla.

[21] Appl. No.: 452,751

[22] Filed: May 30, 1995

[51] Int. Cl.[6] ..... E21B 43/04; E21B 43/267; E21B 33/138

[52] U.S. Cl. ..... 166/281; 166/276; 166/280; 166/278

[58] Field of Search ..... 166/308, 278, 166/276, 280, 281, 292, 293, 295, 297; 523/130

[56] References Cited

U.S. PATENT DOCUMENTS

| | | | |
|---|---|---|---|
| 3,708,013 | 1/1973 | Dismukes | 166/276 |
| 3,789,927 | 2/1974 | Gurley et al. | 166/308 X |
| 4,199,484 | 4/1980 | Murphey | 523/130 |
| 4,979,565 | 12/1990 | Jennings, Jr. | 166/276 X |
| 5,121,795 | 6/1992 | Ewert et al. | 166/292 |
| 5,128,390 | 7/1992 | Murphey et al. | 523/130 |

*Primary Examiner*—Stephen J. Novosad
*Attorney, Agent, or Firm*—Craig W. Roddy; Robert A. Kent; C. Clark Dougherty, Jr.

[57] ABSTRACT

Methods of combating production problems in wells containing defective gravel packs are provided. The methods basically comprise forming at least one perforation in the well bore extending from the well bore through the defective gravel pack and into the producing formation, forming at least one fracture containing proppant material in the formation communicating with the perforation and consolidating the proppant material in the fracture.

20 Claims, No Drawings

METHODS OF COMBATING PRODUCTION PROBLEMS IN WELLS CONTAINING DEFECTIVE GRAVEL PACKS

BACKGROUND OF THE INVENTION

1. Field of the Invention

The present invention relates to methods of combating production problems in wells containing defective gravel packs, and more particularly, to such methods whereby the defective gravel packs are inexpensively bypassed.

2. Description of the Prior Art

In completing oil, gas and water wells, a string of casing is often run into the well bore and cemented therein. A string of production tubing is run in the casing, and the well is perforated in one or more production zones to allow formation fluids to enter the casing. Formation fluids that flow through the perforations into the interior of the casing are produced to the surface through the production tubing.

During the production of fluids from a poorly consolidated formation, sand from the formation is often also produced which is carried with the fluids into the well and into production equipment. The presence of sand in the produced fluids causes erosion and other damage to the tubular goods and equipment through which the fluids flow.

In order to eliminate or reduce the production of formation sand, gravel packs have commonly been utilized heretofore. That is, a sand screen is placed in a well bore penetrating a poorly consolidated formation adjacent to the perforations through which formation fluids are produced. A packer is typically set above the sand screen and the annulus around the screen is then packed with a relatively coarse sand, commonly referred to as gravel. The gravel pack which is formed around the sand screen as well as in the perforations filters sand out of the in-flowing formation fluids.

While such gravel packs have been utilized extensively, they often develop defects which in turn cause production problems. For example, even when a gravel pack is consolidated by a hardenable resin composition, it can break down and allow the production of some sand with the formation fluids. The production of the sand eventually causes the sand screen to cut out whereby greater amounts of sand are produced. In other circumstances, the gravel pack may become plugged or partially plugged with debris from previously utilized stimulation or completion fluids whereby formation fluid production is materially decreased.

When a gravel pack becomes defective, its replacement has heretofore been difficult and expensive. Thus, there is a need for improved methods of combating production problems in wells containing defective gravel packs which are relatively simple and economical to carry out.

SUMMARY OF THE INVENTION

By the present invention improved methods of combating production problems in wells containing defective gravel packs which meet the above described need and obviate the shortcomings of the prior art are provided. The methods basically comprise forming at least one fracture containing proppant material in the formation by pumping a fracturing fluid having proppant material suspended therein through the gravel pack and into the formation at a rate and pressure such that the formation is fractured and the proppant material is deposited in the fracture. The proppant material is then consolidated into a hard permeable mass.

The proppant material, and optionally, the gravel in the gravel pack can be consolidated by coating the proppant material and gravel with a hardenable resin composition and allowing the composition to harden. Alternatively, the proppant material and gravel pack can be consolidated by placing a through-tubing sand screen within the well bore adjacent the gravel pack and packing additional gravel between the screen and the formation.

In a preferred method of this invention, the defective gravel pack is first plugged whereby the well bore is isolated from the producing formation. Perforations are formed in the well bore extending from the well bore through the gravel pack and into the producing formation. A fracture or fractures containing proppant material are then formed in the formation by way of the perforations and the proppant material is consolidated.

The plugging of the defective gravel pack can be accomplished in various ways. A preferred technique is to squeeze a cement composition into the gravel pack and allow the cement to set therein.

It is, therefore, a general object of the present invention to provide improved methods of combating production problems in wells containing defective gravel packs.

Other and further objects, features and advantages of the present invention will be readily apparent to those skilled in the art upon a reading of the description of preferred embodiments which follows.

DESCRIPTION OF PREFERRED EMBODIMENTS

As mentioned, wells drilled into poorly consolidated formations which produce desirable fluids such as oil and gas must be completed in a manner whereby formation sand is not carried into the well bore and into associated production equipment by the produced fluids. An often utilized such completion technique has been to form a gravel pack between the producing formation and production tubing disposed in the well bore which functions to screen out sand carried by produced fluids before the fluids enter the production tubing.

Typically, a string of casing is cemented in a well bore penetrating a poorly consolidated formation. That is, a cement slurry is pumped into the annulus between a string of casing and the walls of the well bore and allowed to set therein whereby the casing is bonded to and sealed in the well bore. Thereafter, the well is perforated whereby one or more perforations are formed through the casing and cement into the poorly consolidated formation. A sand screen is then placed adjacent to the perforations and a packer is usually set above the sand screen to seal the annulus between the top of the sand screen and the casing. A relatively coarse sand, referred to as gravel, is then placed in the annulus between the screen and the casing as well as in the perforations for filtering sand out of the in-flowing formation fluids. A string of production tubing disposed within the casing is connected to the open top of the sand screen so that fluids produced through the gravel pack flow through the sand screen into the tubing and upwardly to surface production equipment.

While such gravel packs have proven to be highly successful and advantageous in preventing the production of sand with formation fluids, as time goes by production problems often occur as a result of the development of defects in the gravel packs. For example, a gravel pack may break down whereby some formation sand flows through the gravel pack and through the sand screen. After a period of time, the small openings in the sand screen become enlarged or cut out and the quantity of produced sand increases. Gravel packs can also become plugged or partially plugged whereby the production of formation fluids is reduced. The plugging can occur as a result of debris moving from the formation into the gravel pack. The debris can be naturally occurring materials from the formation or debris produced in the formation as a result of contact with drilling fluids, completion fluids and/or stimulation fluids.

Once a gravel pack has developed a defect whereby the production of formation fluids is reduced and/or sand is produced along with formation fluids into the well bore, or both, the defective gravel pack has generally had to be replaced. The replacement of a gravel pack in a well is both difficult and expensive.

By the present invention, methods are provided for combating production problems in wells containing defective gravel packs which are relatively simple and inexpensive to carry out. The methods basically comprise the steps of forming at least one fracture containing proppant material such as sand, glass beads, sintered bauxite or the like in the formation by pumping a fracturing fluid having a proppant material suspended therein through the gravel pack and into the formation at a rate and pressure such that the formation is fractured and the proppant material is deposited therein. The proppant material, and optionally, the gravel in the gravel pack are then consolidated.

The consolidation of the fracture proppant material and gravel in the gravel pack can be accomplished in various ways. One technique is to place a through-tubing sand screen and associated gravel packing tools in the well bore adjacent the original gravel pack after the propped fracture has been formed in the producing formation. Additional gravel is then packed between the newly placed sand screen and the formation in a conventional manner whereby gravel, proppant material and formation sand are prevented from flowing with produced fluids into the well bore.

A more preferred technique for consolidating the proppant material and gravel in the original gravel pack is to coat the proppant material and gravel with a hardenable resin composition which subsequently hardens and forms the proppant material and gravel into a solidified permeable mass. The use of resin compositions for coating gravel, sand and proppant material in a desired location in a well is described in U.S. Pat. No. 4,199,484 issued Apr. 22, 1980 to Murphey, and the use of a resin composition coated proppant material to consolidate the proppant material after its deposit in a location in a well is described in U.S. Pat. No. 5,128,390 issued on Jul. 7, 1992 to Murphey et al., both of such patents being assigned to the assignee of this present invention and incorporated herein by reference.

A preferred fracturing fluid for use in accordance with the present invention is comprised of a gelled aqueous liquid having a hardenable resin composition coated proppant material, preferably sand, suspended therein. Upon being deposited in the fracture or fractures created with the fracturing fluid, the resin coated proppant material is consolidated into a hard permeable mass.

In forming an aqueous high viscosity gelled fracturing fluid, substantially any aqueous liquid including fresh water, salt water, brines, seawater and the like can be used so long as the aqueous liquid does not adversely react with other components making up the fracturing fluid. However, the aqueous liquid most often employed is fresh water containing a low concentration of a clay stabilizing salt such as potassium chloride.

A gelling agent is added to the aqueous liquid to increase the viscosity thereof. While a variety of well known gelling agents can be used, polysaccharide gelling agents are the most commonly used for forming high viscosity gelled treating fluids. Such polysaccharide gelling agents are generally selected from the group consisting of galactomannan gums, modified or derivative galactomannan gums and cellulose derivatives. Examples of galactomannan gums which can be utilized include arabic gum, ghatti gum, karaya gum, tamarind gum, tragacanth gum, guar gum, locust bean gum and the like. Such gums can be modified such as by forming carboxyalkyl and hydroxyalkyl derivatives thereof. Examples of such derivatives which are particularly suitable are carboxymethyl guar and hydroxypropyl guar. Double derivatives can also be utilized, e.g., carboxymethylhydroxypropyl guar.

Modified celluloses and derivatives thereof can also be utilized as gelling agents. In general, any of the water soluble cellulose ethers can be used such as the various carboxyalkyl cellulose ethers, e.g., carboxyethyl cellulose and carboxymethyl cellulose. Mixed ethers such as carboxymethylhydroxyethyl cellulose and hydroxyalkyl celluloses such as hydroxyethyl cellulose can also be utilized. Further, alkyl celluloses such as methyl cellulose, and alkylhydroxyalkyl celluloses such as methylhydroxypropyl cellulose; alkylcarboxyalkyl celluloses such as ethylcarboxymethyl cellulose; alkylalkyl celluloses such as methylethyl cellulose; and hydroxyalkylalkyl celluloses such as hydroxypropylmethyl celluloses can all be utilized.

The preparation of high viscosity gelled aqueous fluids for fracturing subterranean formations is well understood by those skilled in the art. The amount of gelling agent employed in the base aqueous liquid depends upon the desired final viscosity of the resulting solution. Generally, the gelling agent is combined with the aqueous liquid in an amount in the range of from about 10 pounds to about 200 pounds per 1,000 gallons of aqueous liquid. A polysaccharide gelled aqueous liquid which is not crosslinked (known in the art as a linear gel) can develop a relatively high viscosity, e.g., as high as from about 10 to about 300 centipoises measured on a Fann Model 35 viscometer at 70° F. and at an RPM of 300. A fracturing fluid which must carry proppant material suspended therein is usually crosslinked to further increase its viscosity. While a variety of crosslinking agents can be utilized for crosslinking a polysaccharide gelled aqueous liquid, particularly suitable such crosslinking agents are transition metal containing compounds which release transition metal ions when dissolved in an aqueous liquid. The particular crosslinking agent utilized is generally combined with a gelled aqueous fracturing fluid in the form of an aqueous concentrate in an amount in the range of from about 0.1 gallon to about 5 gallons per 1,000 gallons of water in the fracturing fluid.

After a high viscosity gelled aqueous fracturing fluid has been introduced into fractures formed therewith in a formation, it is caused to revert to a relatively low viscosity liquid whereby proppant materials suspended therein are deposited in the fracture and the liquid can be reverse flowed out of the formation. Generally, a gel breaker for converting the high viscosity fracturing fluid to a low viscosity fluid is included in the fluid prior to introducing it into the subterranean formation to be fractured. Heretofore utilized gel breakers include enzymes or water soluble persulfates and various other compounds well known to those skilled in the art.

While a poorly consolidated formation penetrated by a well bore can be fractured by pumping a fracturing fluid through a defective gravel pack in the well bore and through the original perforations formed in the well bore, it is often more efficient to plug the defective gravel pack first followed by forming additional perforations through the plugged gravel pack and then fracturing the formation. More specifically, the defective gravel pack can be plugged by pumping a hardenable fluid into the gravel pack and allowing the fluid to harden therein. Preferably, the defective gravel pack is plugged by squeezing a cement composition into the gravel pack and into the original perforations, and then allowing the cement composition to set whereby the well bore is isolated from the producing formation.

While any suitable cement composition can be utilized, aqueous hydraulic cement compositions are commonly used in well cementing operations and are preferred. Such cement compositions are comprised of hydraulic cement, water present in an amount sufficient to form a pumpable slurry and a variety of additives such as set retarding additives, fluid loss reducing additives and the like.

Portland cement is commonly utilized in well cementing compositions, and can be, for example, one or more of the various types identified as API Classes A–H and J cements. These cements are described and defined in *API Specification For Materials And Testing For Well Cements,* API Specification 10A, 21st Edition, dated Sep. 1, 1991 of the American Petroleum Institute which is incorporated herein by reference.

API Portland cements generally have a maximum particle size of about 90 microns and a specific surface (sometimes referred to as Blaine Fineness) of about 3900 square centimeters per gram. A highly useful cement slurry base for use in carrying out well cementing operations is comprised of API Portland cement mixed with water to provide a density of from about 11.3 to about 18.0 pounds per gallon.

A particularly preferred aqueous hydraulic cement composition for use in accordance with the present invention wherein the cement composition is squeezed into a defective gravel pack to be plugged is an aqueous fine particle size hydraulic cement composition. Fine particle size hydraulic cement generally consists of particles having diameters no larger than about 30 microns and having a Blaine Fineness no less than about 6,000 square centimeters per gram. An aqueous cement composition comprised of fine particle size cement is capable of entering very small openings such as those in gravel packs. Fine particle size hydraulic cements and their use in well squeeze cementing operations are disclosed in U.S. Pat. No. 5,121,795 to Ewert et al. assigned to the assignee of this present invention and incorporated herein by reference.

The water used in aqueous hydraulic cement compositions is generally present therein in the range of from about 30% to about 60% by weight of dry cement in the compositions when the cement is of normal particle size. When a cement of fine particle size as described above is used, water is generally present in the cement composition in an amount in the range of from about 100 to about 200% by weight of dry cement in the composition, and a dispersing agent such as the dispersing agent described in U.S. Pat. No. 4,557,763 issued on Dec. 10, 1985 to George et al. is generally included to facilitate the formation of the cement slurry and prevent the premature gellation thereof.

As is well understood by those skilled in the art, to obtain optimum results in well cementing applications a variety of additives are included in the cement compositions utilized. Such additives are used in the cement compositions to vary the density, increase or decrease strength, accelerate or retard the time of setting, reduce fluid loss, etc. The preferred and most commonly used cement compositions for use in accordance with the present invention are those meeting the specifications of the American Petroleum Institute comprising fine particle size Portland cement mixed with water and other additives to provide a cement composition having properties appropriate for the conditions existing in each individual defective gravel pack to be plugged.

As mentioned, in carrying out a squeeze cementing operation to plug a defective gravel pack, the cement composition is squeezed into the gravel pack and the originally formed perforations using conventional tools and procedures which are well known to those skilled in the art. Once the cement composition has been placed in the gravel pack and perforations, it is allowed to set into a hard substantially impermeable mass therein whereby the well bore is isolated from the producing formation.

After the defective gravel pack has been plugged, at least one perforation is formed in the well bore extending from the well bore through the plugged gravel pack and into the producing formation. At least one fracture containing proppant material is next formed in the producing formation communicating with the perforation. As mentioned, the proppant material can be any suitable particulate material such as sand, glass beads, sintered bauxite, ceramic material or the like with sand being the most preferred. After the fracture containing proppant material has been formed, the proppant material in the fracture and perforation is consolidated utilizing one of the techniques described above.

A typical remedial operation performed in accordance with the present invention is undertaken when problems such as reduced oil and/or gas production or the migration of sand with formation fluids, or both, are experienced as a result of a defective gravel pack. The well bore usually includes casing cemented therein, perforations extending through the casing into the formation, a defective gravel pack which includes a sand screen positioned adjacent to the perforations and a production tubing string connected to the sand screen.

If the state of the defective gravel pack is such that a fracture can be formed in the producing formation through the gravel pack and through the original perforations, one or more fractures are formed by pumping a fracturing fluid containing proppant material into the formation as described above. If the defective gravel pack and perforations are plugged or partially plugged by debris, one or more new perforations can be formed extending through the gravel pack into the formation prior to forming the fracture or fractures.

In most cases, and in order to insure that the defective gravel pack does not subsequently permit the production of formation fluids containing sand, it is preferred that the defective gravel pack and original perforations be plugged with cement or other plugging material as described above. After the defective gravel pack is plugged, new perforations are formed extending from the well bore through the plugged gravel pack into the producing formation and the formation is fractured. During the fracturing process the fractures as well as the perforations are filled with proppant material. The proppant material is consolidated by coating the proppant material with a hardenable composition and allowing the composition to harden in the fractures and perforations. Alternatively, a through-tubing sand screen is placed adjacent to the perforations and a new gravel pack is formed between the sand screen and the formation.

Thus, the present invention is well adapted to carry out the objects and attain the ends and advantages mentioned as well as those inherent therein. While numerous changes may be made by those skilled in the art, such changes are encompassed within the spirit of this invention as defined by the appended claims.

What is claimed is:

1. A method of stimulating production or preventing sand migration, or both, into a well bore from a hydrocarbon producing formation penetrated by the well bore, the well bore being communicated with the formation by way of a defective gravel pack, comprising the steps of:

forming at least one fracture containing proppant material in said formation by pumping a fracturing fluid having proppant material suspended therein through said gravel pack and into said formation at a rate and pressure such that said formation is fractured and said proppant material is deposited in said fracture; and consolidating said proppant material and said gravel pack.

2. The method of claim 1 wherein said fracturing fluid is a gelled aqueous fluid.

3. The method of claim 2 wherein said proppant material is sand.

4. The method of claim 1 wherein said proppant material and gravel pack are consolidated by coating said proppant material and gravel pack with a hardenable composition and allowing said composition to harden.

5. The method of claim 1 wherein said proppant material and gravel pack are consolidated by placing a sand screen within said well bore adjacent said gravel pack and packing additional gravel between said screen and said formation.

6. The method of claim 1 which further comprises plugging said defective gravel pack whereby said well is isolated from said producing formation and perforating said well prior to fracturing said formation.

7. The method of claim 6 wherein said defective gravel pack is plugged by pumping a cement composition into said gravel pack and allowing said cement composition to set therein.

8. The method of claim 7 wherein said cement composition is an aqueous fine particle size cement slurry.

9. A method of stimulating production or preventing sand migration, or both, into a well bore from a hydrocarbon producing formation penetrated by the well bore, the well bore being communicated with the formation by way of a defective gravel pack, comprising the steps of:

plugging said defective gravel pack whereby said well bore is isolated from said producing formation;

forming at least one perforation in said well bore extending from said well bore through said gravel pack and into said producing formation;

forming at least one fracture containing proppant material in said formation communicating with said perforation; and consolidating said proppant material.

10. The method of claim 9 wherein said fracture containing proppant material is formed by pumping a fracturing fluid having proppant material suspended therein through said perforation and into said formation at a rate and pressure such that said formation is fractured and said proppant material is deposited in said fracture.

11. The method of claim 10 wherein said fracturing fluid is a gelled aqueous fluid.

12. The method of claim 11 wherein said proppant material is sand.

13. The method of claim 9 wherein said proppant material is consolidated by coating said proppant material with a hardenable resin composition and allowing said composition to harden in said fracture.

14. The method of claim 13 wherein said proppant material is consolidated by placing a sand screen within said well bore adjacent said perforation and packing additional gravel between said screen and said formation.

15. The method of claim 9 wherein said defective gravel pack is plugged by pumping a cement composition into said gravel pack and allowing said cement composition to set therein.

16. The method of claim 15 wherein said cement composition is an aqueous fine particle size cement slurry.

17. A method of stimulating production and preventing sand migration into a well bore from a hydrocarbon producing formation penetrated by the well bore, the well bore having casing cemented therein, perforations extending through the casing and cement into the formation, a defective gravel pack including a sand screen positioned adjacent to the perforations, and a production tubing string connected to the sand screen of the gravel pack, comprising the steps of:

plugging said defective gravel pack whereby said well bore is isolated from said formation by pumping a fine particle size cement slurry into said gravel pack and into said perforations and allowing said cement slurry to set therein;

forming a plurality of perforations through said sand screen, said plugged gravel pack, said casing and cement into said producing formation;

forming at least one fracture containing proppant material in said formation communicating with said perforations; and consolidating said proppant material.

18. The method of claim 17 wherein said fracture containing proppant material is formed by pumping a fracturing fluid having proppant material suspended therein through said perforations and into said formation at a rate and pressure such that said formation is fractured and said proppant material is deposited in said fracture.

19. The method of claim 18 wherein said proppant material is sand which is consolidated by coating said sand with a hardenable resin composition and allowing said composition to harden in said fracture.

20. The method of claim 18 wherein said proppant material is consolidated by placing a sand screen within said well bore adjacent said perforations and packing additional gravel between said screen and said formation.

* * * * *